US005297545A

United States Patent [19]

Infante

[11] Patent Number: 5,297,545

[45] Date of Patent: Mar. 29, 1994

[54] UNDERWATER BREATHING DEVICE

[75] Inventor: Anthony M. Infante, Clearwater, Fla.

[73] Assignee: Snorkel Systems, Clearwater, Fla.

[21] Appl. No.: 874,108

[22] Filed: Apr. 27, 1992

[51] Int. Cl.[5] ..... A62B 7/12

[52] U.S. Cl. ..... 128/204.18; 114/315; 128/201.11; 128/205.22; 128/204.26

[58] Field of Search ..... 128/201.11, 201.27, 128/201.28, 204.18, 204.26, 205.22, 200.24, 202.14, 202.12, 205.26, 201.21; 114/315; 441/1, 136

[56] References Cited

U.S. PATENT DOCUMENTS

| | | | |
|---|---|---|---|
| 4,805,610 | 2/1989 | Hunt | 128/201.11 |
| 5,027,805 | 7/1991 | Kung | 128/201.11 |
| 5,092,327 | 3/1992 | Tragatschnig | 128/205.18 |
| 5,134,994 | 8/1992 | Say | 128/200.24 |

FOREIGN PATENT DOCUMENTS

| | | | |
|---|---|---|---|
| 1909680 | 8/1970 | Fed. Rep. of Germany | 128/201.11 |
| 2148128 | 5/1985 | United Kingdom | 128/201.11 |

*Primary Examiner*—Edgar S. Burr
*Assistant Examiner*—Lynn D. Hendrickson
*Attorney, Agent, or Firm*—David A. Kiewit

[57] ABSTRACT

An electrically-powered, diver-borne air compressor is used with a draw-type snorkel to supply air from above the surface to a swimmer. The use of a non-positive displacement compressor—e.g. a blower—allows a shallowly submerged swimmer to breathe through the apparatus when the motor is turned off, which provides extended battery life. The compressor is selected to provide an adequate volume of air to a diver submerged at the depth limit set by the length of the flexible air conduit leading from the surface to his/her mouthpiece. In the simplest embodiment of the invention, the excess air supplied to a less deeply submerged diver is vented through an exhaust valve. In other embodiments, which offer improved operational efficiency at the cost of greater complexity, this otherwise excess air is stored in a tank. When the tank becomes full the compressor is turned off (either manually or automatically) until the stored air is exhausted.

8 Claims, 4 Drawing Sheets

UNDERWATER BREATHING DEVICE

BACKGROUND OF THE INVENTION

This invention relates generally to the field of draw-type snorkels, and adds to pre-existing art an electrically powered diver-borne compressor that can be used to supply air to a free-swimming diver.

The prior art of interest to the present invention dates back more than a century. In U.S. Pat. No. 0,156,599, issued in 1874, Schmitz taught a breathing aid for a shallowly submerged diver. His device had inlet and outlet breathing tubes running to a diver from a surface float. A more recent teaching in the same area is provided by one of the present inventors in his application Ser. No. 07/790,530, the disclosure of which is herein incorporated by reference.

The maximum inspiration pressure that a diver can supply severely limits the utility of equipment such as that provided by Schmitz. Schmitz's device could not be used when the diver's chest was submerged more than about 30–40 cm.

Numerous devices have employed a compressor mounted above the surface of the water to supply air to a diver. Shipboard-mounted, manually-actuated compressors have been used for over a century to supply air to a "hardhat" diver. A compressor mounted on a smaller floation means than a boat or ship, i.e. an automobile inner tube, and powered by a small internal combustion engine is also known in the art for supplying air to free-swimming divers. Mitchell, in U.S. Pat. No. 4,674,493, improves on this art with a battery-powered compressor mounted on a surface float that can be towed behind a free-swimming diver. Kroling, in U.S. Pat. No. 4,472,082, teaches a manually-operable compressor mounted on a surface float. Kroling's compressor is operated by cables pulled by the diver.

There are also prior art compressors intended to be carried below the surface by a diver:

Houston, in U.S. Pat. No. 4,245,632, teaches an underwater breathing apparatus that includes two positive displacement compressors carried by the diver. One of Houston's compressors is operated by the diver's exhalations; the other is operated by hand.

Vautin, in U.S. Pat. No. 3,050,055 teaches a diver-mounted apparatus including two piston-type compressors and an air tank. The compressors are actuated by the diver's swimming motions. An improved diver-powered breathing apparatus of this sort is taught by Tragatschnig in U.S. Pat. No. 5,092,327, the teaching of which is herein incorporated by reference. Tragatschnig's apparatus is sold under the name "DIVEMAN", and is distributed in the United States by DIVEMAN America of Clearwater, Fl.

Gross, in U.S. Pat. No. 3,124,131, teaches an electrically-powered compressor on a diver's backpack. Gross' apparatus is configured for a diver who walks generally upright on the bottom of a body of water. Gross' unusual air compressor comprises an air and water mixing apparatus (of a sort originally developed for sewage treatment) that bubbles breathable air through water in a pre-inspiration chamber that has an open bottom. Gross' apparatus is of no value to a free-swimming diver, as free-swimming divers adopt a head-down attitude when submerging. This would cause Gross' apparatus to deliver water into the breathing tube.

SUMMARY OF THE INVENTION

It is an object of the invention to provide an underwater breathing apparatus that provides a source of dry air to a free-swimming diver.

It is a further object of the invention to provide an underwater breathing apparatus comprising a surface float that holds an air inlet above the surface of the water and a battery-powered blower, carried and controlled by a free-swimming diver, to deliver air for the diver to breathe.

It is an additional and related object of the invention to provide an underwater breathing apparatus comprising a surface float that holds an air inlet above the surface of the water, and a battery-powered blower that is carried and controlled by a free-swimming diver, and that can be turned off by the diver to conserve battery energy.

It is yet a further object of some embodiments of the invention to provide an underwater breathing apparatus with an air inlet above the surface of the water and a, battery-powered blower located on that operates under automatic control to deliver required amounts of surface air to the diver and that is automatically turned off when a diver-borne air tank is filled.

It is a further object of the invention to provide an underwater breathing apparatus that uses a, battery-powered blower located on that allows the diver to breathe normally through the apparatus when he/she is swimming near the surface and the battery-powered blower is turned off.

DESCRIPTION OF THE PREFERRED EMBODIMENT

Figure 1:
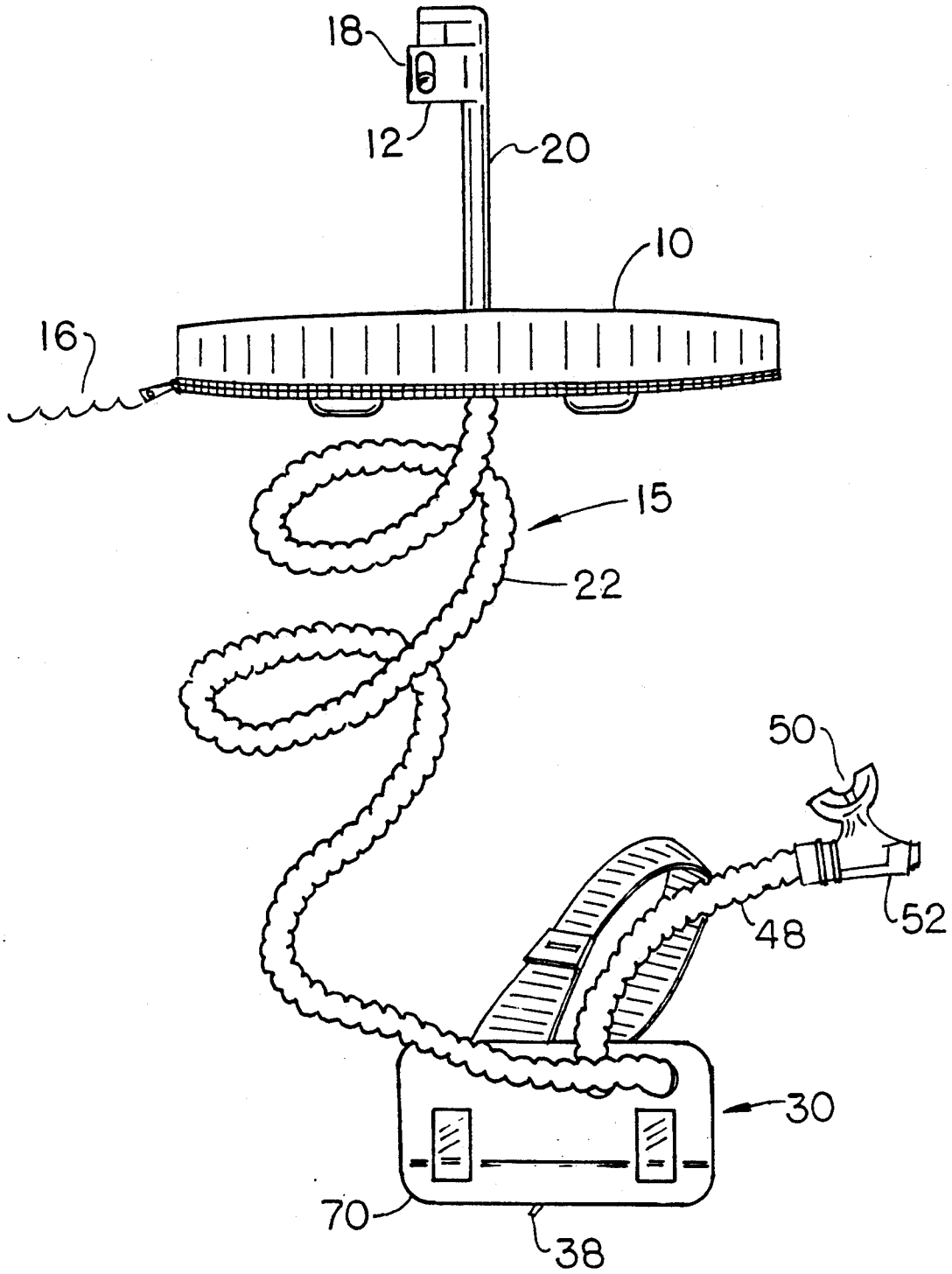
FIG. 1 of the drawing is an elevational view of one embodiment of the invention in a position to be used by a diver.

Turning now to FIG. 1 of the drawing, one finds a depiction of what is perhaps the simplest embodiment of the invention. A float 10, which may be a solid buoyant platform or an inflatable device, is used to hold the inlet 12 of an air conduit 15 above the surface 16 of a body of water. The conduit inlet 12 preferably has a water-excluding check valve 18 to ensure that water does not enter the conduit. Alternately, the inlet 12 may be held sufficiently far above the surface of the water that no such check valve is required.

The upper portion 20 of the conduit secured to the float 10 is preferably rigid, so as to keep the inlet 12 in a defined position and thereby aid in excluding water from the conduit 15. A flexible hose 22 is attached at the bottom of the float to form an intermediate conduit portion extending downwardly from the float to those portions of the apparatus that are near or on the diver's person. This arrangement allows the diver to tow the float 10 behind him as he/she swims underwater. The maximum depth of descent in this configuration is limited by the length of the flexible hose portion 22 of the conduit 15.

Figure 2:
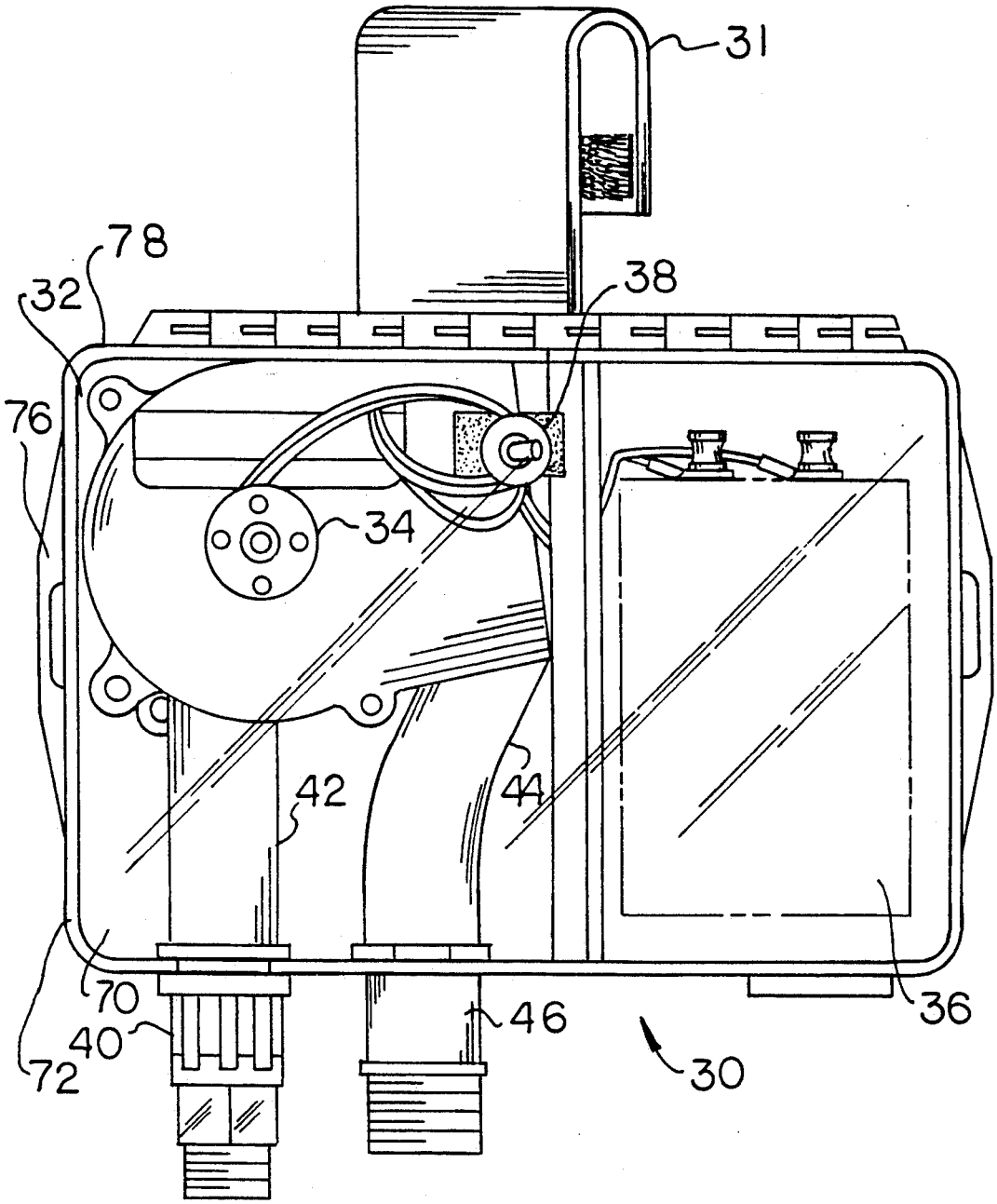
FIG. 2 of the drawing is an elevational view of the housing shown in FIG. 1 and shows the motor, battery, and blower mounted in the housing FIG. 3 of the drawing is a cross-sectional view of an alternative embodiment of the invention that uses an automatically filled air tank, where the filling of the tank is controlled with a limit switch.

Turning now to FIG. 2 of the drawing, one finds a housing 30, that is carried by the diver and secured to his/her person by means of a suitable belt 31 or harness. The housing 30 houses an air compressor (which is preferably a blower such as the centrifugal blower 32 shown in elevation in FIG. 2 and in greater detail in FIG. 3*a*.) that is used to draw air through the conduit 15 from above the surface 16, an electric motor 34 to power the blower 32, a battery 36 to power the motor 34, and a switch 38 that the diver can use to turn the blower on or off. The flexible hose 22 portion of the conduit is joined to an inlet 40 of the blower, which may be equipped with a blower inlet check valve 42. In this embodiment of the invention, the blower inlet check valve 42 is normally omitted. In other embodiments of the invention, as will be subsequently discussed, a check valve in a corresponding position in the conduit is normally called for. The output 44 of the blower 32 may pass through a blower outlet check valve 46. Regardless of whether the outlet check valve 46 is employed, air from the blower passes into a second flexible hose 48 which is connected to a diver's mouthpiece 50 from which the diver may draw air, as shown in FIG. 1 of the drawing. It will be appreciated by those skilled in the art that the blower outlet check valve 46, shown in FIG. 2 as being located at one end of the second flexible hose 48 adjacent the housing 30, could serve the same function if located at the other end of the flexible hose 48, adjacent the diver's mouthpiece 50. The mouthpiece 50 is preferably equipped with an exhaust check valve 52 through which the diver's exhalations pass into the ambient water 55. Alternately, as is known in the art since the time of Schmitz, the diver's exhalations may be conveyed back to the surface via another flexible hose portion of the air conduit (not shown) and exhausted into the ambient air.

Since the air compressor and the switch that controls it are carried by the diver, rather than being located on the float as is taught by Mitchell inter alia, the diver can easily turn the compressor off when it is not needed—i.e. when he/she is near the surface. This feature, as will be subsequently discussed, aids in extending the discharge life of the battery 36 and thereby allows the diver to use the apparatus for a longer period of time.

A blower (e.g. the centrifugal blower 32 of FIG. 2), which has an impeller 56 located inside a cavity 58 that forms a portion of the air conduit 15, is a preferred type of compressor for moving air from the surface 16 to the diver. The use of a blower, rather than a positive displacement pump, such as those earlier taught by Houston, by Kroling, and by Vautin, allows the diver to breathe through the compressor when the electric drive motor is turned off. The combination of a low off-state air flow impedance and a diver-controlled switch provides the benefit of extended battery life that was previously mentioned.

When a diver swimming at or near the surface chooses to shut off the compressor and continue to breathe through the conduit 15, the combination of two check valves, one upstream and the other downstream of the mouthpiece 50, ensure that the diver's exhalations pass into the water, rather than flowing back up the conduit 15. Keeping exhaled air out of the air conduit 15 ensures that the diver will not re-breathe stale air that is contaminated with carbon dioxide. One-way flow in air conduit 15 is ensured by the combination of blower output check valve 46 and exhaust check valve 52. Blower inlet check valve 42, although it provides a redundant assurance of one-way flow through conduit 15, is normally omitted from the apparatus of FIG. 2 in order to minimize overall flow impedance through conduit 15 when the compressor 32 is turned off.

Although a variety of blowers can be used with the invention, the prototype illustrated in FIG. 2 of the drawing used a Globe Motors 19A-2939 centrifugal blower, indicated with the reference numeral 32 in FIG. 2. It is expected that future embodiments of the invention will employ other commercially available blowers to improve overall electrical efficiency (which would allow for a reduction in capacity and size of the battery 36), to provide operation a greater depths, or to reduce the size of the housing 30 that is carried by the diver.

Although any electric motor that can be powered from a battery source could be considered to drive the compressor, a brushed or brushless motor 34 that operates at 12 V DC is preferred and has been used in prototype tests.

A Power-Sonic model PS-1207 rechargeable sealed lead-acid battery 36 was used for prototype tests. This unit provides a 1 hour capacity of 0.48 AH at a nominal 12 V output. The weight of the battery 36, which is of clear concern in any diver-borne system that is to allow more than one descent, is 0.35 kG for the preferred unit.

A housing 30, shown in FIG. 2 of the drawing, holds the blower 32, motor 34, battery 34, and switch 38. The housing 30 has a hinged cover 70 that is normally sealed with a gasket 72. The cover 70 may be opened to connect an external source of DC charging voltage (not shown) to the battery via recharging contacts (not shown), or to perform whatever service operations might be required on components within the housing. A loop or loops 76 are provided on the housing 30 so that a belt or harness may be threaded through them and used to secure the housing 30 to the body of the diver.

Figure 3:
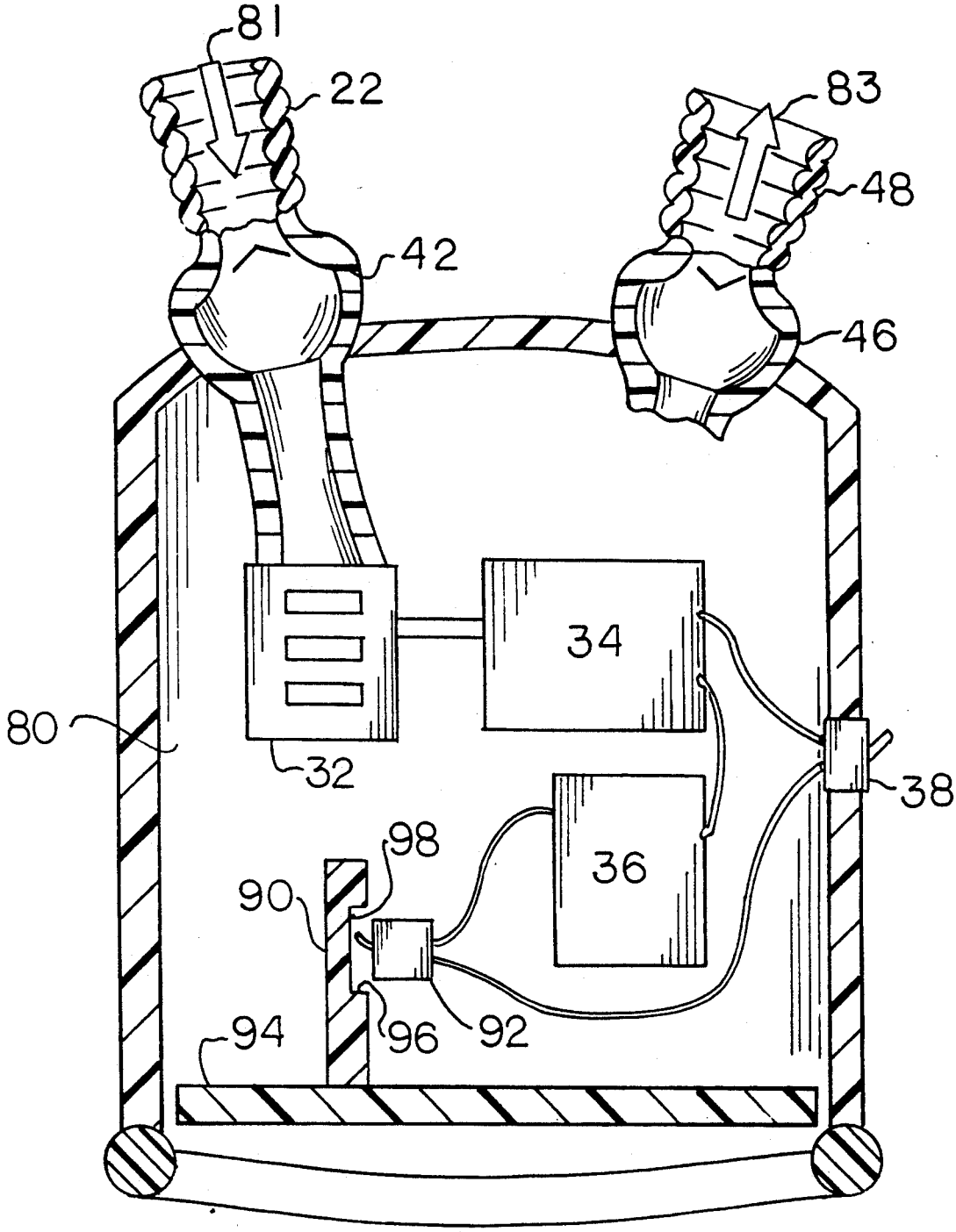
Figure 4:
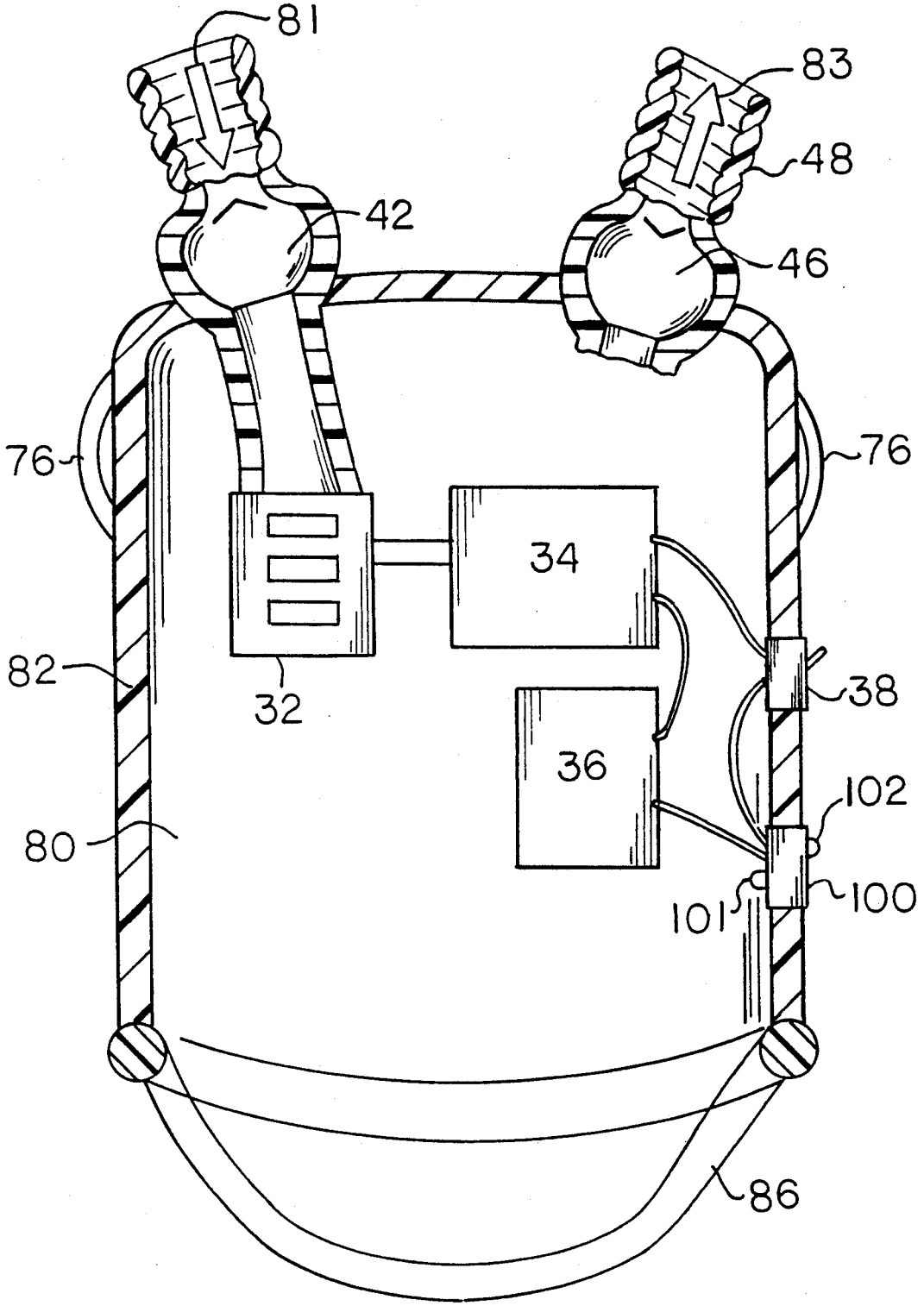
FIG. 4 of the drawing illustrates a third embodiment of the invention that uses a flexible-walled air storage vessel that may be automatically filled under the control of a differential pressure switch.

A waterproof switch 38 is conveniently mounted in the hinged cover 70, as shown in FIG. 2 of the drawing, or in a wall portion 82 of the housing, as shown in FIGS. 3–4. This switch may be operated by the diver to turn the compressor 32 OFF when he/she is at or very near the surface, or to turn the compressor 32 ON when he/she submerges more deeply.

It should be appreciated that the requirement that the compressor 32 be chosen to supply an adequate amount of air at the maximum depth of submergence, combined with the simple manual switch of FIG. 2, and the limited and fixed volume of the housing 30, has the detrimental effect of wasting battery energy by providing excess air to the diver when he/she is submerged at less than the maximum depth. That is, at shallow depths, the compressor supplies more air than is needed and the excess air is vented through the exhaust check valve 52. In tests done on prototype equipment, such as that shown in FIG. 2 of the drawing, dives were made to depths as great as about 6 m and appreciable volumes of excess air were vented when the diver was near the surface. Efforts to extend the maximum depth of operation (which would certainly involve a longer hose 22, and would almost assuredly require the use of a different blower 32) indicate the desireability of those embodiments of the invention that will be discussed subsequently in this specification.

Alternate embodiments of the apparatus of the invention will use a nearly-constant-pressure, variable-volume air reservoir 80 and are shown in FIGS. 3 and 4. These embodiments differ from that of FIG. 1 in that they include different components and features in the diver-borne housing. The embodiments of FIGS. 3 and 4, seek to conserve battery energy and extend diving time by using an air storage tank and by providing automatic control for the compressor. The choice of which embodiment is preferred is a matter of performance and economics, as will become clear from the following discussion.

Turning now to FIG. 3 of the drawing, one finds a housing 82 that is somewhat larger than the housing 30 shown in FIG. 1, and that has external loops 76 on it that adapt it to be mounted via a harness (not shown) on the diver's chest as is taught by Tragatschnig. The housing 82 may include a sealed hatch (not illustrated) that may be opened for access to the interior thereof, as may be required, for example, to connect the battery 36 to an external electric power source for recharging. The interior portion of the housing, which is a portion of the air conduit, is used as an air reservoir 80, and preferably has a flexible wall 86 or moveable wall section that moves so as to expand the air reservoir 80 in order to store air drawn from above the surface 16 of the water by the compressor 32, as is indicated by arrow 81. The moveable septum 86 moves or collapses inwards when the stored air is inhaled by the diver. Motion of inhaled air from the air reservoir 80 to the diver is indicated in FIGS. 3 and 4 by arrow 83.

The blower inlet check valve 42, which was preferably omitted from the "tankless" apparatus of FIGS. 1 and 2, is to be an important element of the "tanked" embodiments of the invention shown in FIGS. 3 and 4 of the drawing. If the blower inlet check valve 42 were omitted from the "tanked" embodiments, then whatever air was stored in the air reservoir 80 would flow back through the flexible hose 22 and escape through the conduit inlet 12 whenever the compressor 32 was turned off. The water-excluding check valve 18, which normally uses a caged buoyant ball, allows air flow in either direction, and thus does not serve the same function as the blower inlet check valve 42.

It should be noted that small pressure differences are also of importance in the operation of the apparatus of the invention. Mounting the air reservoir 80 on the chest of the diver, as taught by Tragatschnig, provides a small differential pressure head (i.e. on the order of 10–20 cm of water) between the air reservoir 80 and the diver's lungs. This pressure head tends to aid the diver's inhalation. It may be noted that if the blower outlet check valve 46 and the exhaust valve 52 opened at a too low a pressure, the pressure in the air reservoir 80 would act to empty that reservoir through the exhaust valve 52. The use of rubber (e.g. a clear silicone elastomer) poppets as the moveable elements in these valves 42, 46, 52 is expected to ensure that enough over-pressure is needed to open the valves so that the undesired venting of the air reservoir 80 through the blower outlet check 46 and exhaust 52 valves does not occur. Silicone rubber poppet valves are among the most common type of check valves used in conventional valved snorkels, although flap valves, such as those shown as 42 in FIGS. 3 and 4, are also commonly employed.

Turning now to FIG. 3 of the drawing, one finds a view of an underwater breathing apparatus in which the process of cycling the compressor is automated by turning the motor on with a limit switch when the volume of air in the tank falls to a minimum value and turning the motor off when that volume attains a maximum value. Motion of the moveable portion of the housing (which may be a flexible wall, as shown in FIG. 4, or which may be a piston-like element 94 shown in FIG. 3) may be sensed with a piston follower 90 and a snap acting limit switch 92. When the volume of air in the air reservoir 80 reaches a lower design limit and the moveable wall 94 attains a first predetermined position at which a first edge 96 of the piston follower 90 trips the snap-action switch 92, which turns ON motor 34 and draws air into the chamber. The increased air pressure causes the piston 94 to move outward to a second predetermined position at which a second edge 98 of piston follower 90 returns snap-action switch 92 to its OFF position. The manual switch 38 is retained to allow the diver to turn the system off when he/she desires. Other switch actuation mechanisms (e.g. using a separate limit switch at each end of the wall's travel) that provide the simple control functions recited above are well known in the art of linear motion control.

Turning now to FIG. 4 of the drawing, one finds a view of yet another version of the underwater breathing apparatus of the invention. A differential pressure switch 100 which has a pressure input 101 from the air reservoir and a second pressure input 102 from the ambient water is provided in a wall element 82 of the air reservoir 80 of FIG. 4 so as to control operation of the blower 32 in response to the difference in pressure between the air reservoir and the ambient water. The differential pressure switch 100 is well known in the art and includes appropriate mechanical elements (e.g. a diaphragm) that move to open or close an electrical switch in response to the difference in pressure. When that pressure difference falls to a first threshold value, which is equal to a first setpoint of the pressure switch 100, the switch 100 acts to turn on the blower 32 and fill the air reservoir 80. When enough air has been pumped into that reservoir the pressure difference rises to a second threshold value equal to a second set point of the pressure switch 100, and the switch 100 acts to turn off the blower 32.

The setpoints of the pressure switch 100 may be discovered from the same arguments that were previously offered in a discussion of differential pressures important to the apparatus. When the diver has exhausted the air in the air reservoir 80, his/her next attempt to inhale will cause the pressure in the air reservoir 80 to fall below the pressure in the ambient water by as much as 20–30 cm of water (e.g. approximately 2500 Newtons per square meter), thus, the pressure switch 100 may be set to turn on when the pressure in the air reservoir is at least 20 cm of water (e.g. approximately 2000 Newtons per square meter) less than the ambient. The blower 32 is to be shut off before the pressure in the air reservoir rises high enough to unseat the flaps or poppets in the blower outlet valve 46 and in the exhaust check valve 52, and to exhaust air into the water through exhaust check valve 52. Since exhaust check valve 52 is preferably built into the mouthpiece 50, and the mouthpiece is approximately 10 cm above a chest-mounted air tank when the diver is swimming in a normal horizontal position, the maximum differential pressure supplied by the blower 32 may be set to account for this pressure head as well as for the pressure required to unseat the flaps or poppets. Thus, one may set the pressure switch 100 to turn off whenever the pressure in the air reservoir 80 exceeds the pressure of the ambient water by an approximately 1000 Newtons per square meter.

Although several embodiments of the invention have been described herein, those skilled in the art will recognize that many other embodiments and variations are possible and fall within the spirit of the foregoing descriptions. Accordingly, the disclosure of the preferred embodiments is intended to be illustrative, but not limiting, of the scope of the invention which is set forth in the following claims.

I claim:

1. A breathing apparatus for a diver, comprising:

floatation means holding a first end of an air conduit above a surface of water, an air compressor causing air flow through said conduit, a flexible hose, forming a portion of said conduit, said hose attached intermediate said floatation means and an air reservoir located on said diver, said reservoir having a moveable wall portion adapted to move between a first predetermined position and a second predetermined position, said apparatus further comprising limit switch means operatively connected to said moveable wall element, means responsive to said moveable wall being at said first predetermined position to actuate said limit switch to turn said compressor on, and means responsive to said moveable wall being at said second predetermined position to actuate said limit switch to turn said compressor off and a mouthpiece means attached proximate a second end of said conduit.

2. Apparatus of claim 1 wherein said moveable wall element comprises a flexible, distendable wall (86).

3. A breathing apparatus for a diver submerged in water, comprising:

floatation means holding a first end of an air conduit above the surface of said water, an air compressor causing air flow through said conduit, a first flexible hose portion of said conduit attached intermediate said floatation means and an air reservoir located on said diver, said reservoir having a moveable wall portion, said reservoir further comprising a differential pressure switch having a first pressure input responsive to air pressure in said air reservoir and having a second pressure input responsive to pressure of said water surrounding said housing, means responsive to said air pressure in said reservoir being at a first predetermined amount less than said pressure in said water for operating said differential pressure switch to turn said compressor on, and means responsive to said air pressure in said reservoir being a second predetermined amount greater than said pressure in said water to actuate said differential pressure switch to turn said compressor off and a second flexible hose intermediate said reservoir and a mouthpiece means attached proximate a second end of said conduit.

4. Apparatus of claim 3 wherein said first predetermined amount is approximately 2000 Newtons per square meter and said second predetermined amount is approximately 1000 Newtons per square meter.

5. Apparatus of claim 1 further comprising a storage battery located on said diver and an electric motor within said reservoir, said motor and said battery operatively connected to said limit switch, said motor and said battery driving said air compressor, and a first check valve, located at an inlet port to said reservoir, said first check valve operating to allow flow of air from said first end toward said second end of said conduit and operating to prohibit flow of air from said second end toward said first end of said conduit, and a second check valve, located at an outlet port of said reservoir, said second check valve operating to allow flow of air from said first end toward said second end of said conduit and operating to prohibit flow of air from said second end toward said first end of said conduit.

6. Apparatus of claim 3 further comprising a battery located on said diver and an electric motor within said reservoir, said motor and said battery operatively connected to said differential pressure switch, said motor and said battery driving said air compressor, and a first check valve, located at an inlet port to said reservoir, said first check valve operating to allow flow of air from said first end toward said second end of said conduit and operating to prohibit flow of air from said second end toward said first end of said conduit, and a second check valve, located at an outlet port of said reservoir, said second check valve operating to allow flow of air from said first end toward said second end of said conduit and operating to prohibit flow of air from said second end toward said first end of said conduit.

7. Apparatus of claim 1 wherein said air compressor comprises a blower.

8. Apparatus of claim 3 wherein said air compressor comprises a blower.

* * * * *